US009604821B2

(12) United States Patent
Korvenranta et al.

(10) Patent No.: US 9,604,821 B2
(45) Date of Patent: Mar. 28, 2017

(54) TRACTION SHEAVE ELEVATOR WITH DRIVE MEMBER SLIPPAGE CONTROL

(71) Applicant: KONE CORPORATION, Helsinki (FI)

(72) Inventors: Sakari Korvenranta, Hyvinkää (FI); Martti Juurioksa, Espoo (FI)

(73) Assignee: KONE CORPORATION, Helsinki (FI)

( * ) Notice: Subject to any disclaimer, the term of this patent is extended or adjusted under 35 U.S.C. 154(b) by 447 days.

(21) Appl. No.: 14/191,712

(22) Filed: Feb. 27, 2014

(65) Prior Publication Data

US 2014/0246275 A1 Sep. 4, 2014

(30) Foreign Application Priority Data

Mar. 4, 2013 (EP) ..... 13157555

(51) Int. Cl.
*B66B 1/34* (2006.01)
*B66B 11/04* (2006.01)

(52) U.S. Cl.
CPC ..... *B66B 11/0476* (2013.01)

(58) Field of Classification Search
CPC ..... B66B 11/0476
USPC ..... 187/247, 391, 393
See application file for complete search history.

(56) References Cited

U.S. PATENT DOCUMENTS 4,465,162 A * 8/1984 Yokota ..... B66B 11/0476 187/277
5,578,801 A * 11/1996 Hofmann ..... B66B 1/28 187/287
7,578,373 B2 * 8/2009 Shiratsuki ..... B66B 5/12 187/391
7,614,482 B2 * 11/2009 Shikai ..... B66B 5/02 187/391
7,637,357 B2 * 12/2009 Nakagawa ..... B66B 5/185 187/393
7,669,697 B2 * 3/2010 Ueda ..... B66B 5/02 187/292

(Continued)

FOREIGN PATENT DOCUMENTS

EP 1547961 A1 6/2005

OTHER PUBLICATIONS

European Search Report dated Aug. 21, 2013 corresponding to European Patent Application No. 13157555.7.

*Primary Examiner* — Anthony Salata
(74) *Attorney, Agent, or Firm* — Squire Patton Boggs (US) LLP

(57) ABSTRACT

A traction sheave elevator includes a drive machine having an output shaft which is connected to the traction sheave via an endless drive member. An encoder is provided in connection with the traction sheave, and a motor speed detection device is provided. A monitoring unit is provided to which the output signal of the encoder and a speed signal of the motor speed detection device are fed. The monitoring unit includes a comparator which compares the output signal of the encoder with the speed signal of the motor speed detection device, and the monitoring unit initiates an emergency action if the result of the comparison exceeds a threshold value. The solution improves the safety in belt driven traction sheave elevators, particularly if only one belt is used for the transmission between drive machine and traction sheave.

16 Claims, 1 Drawing Sheet

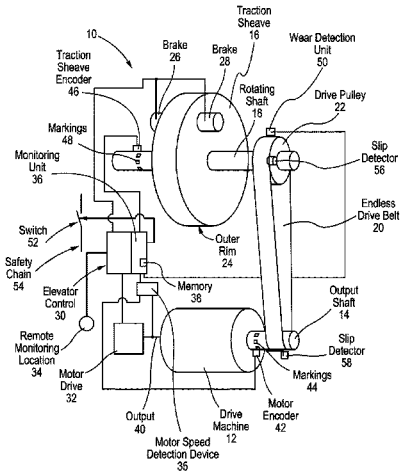

(56) References Cited

U.S. PATENT DOCUMENTS

| | | | | |
|---|---|---|---|---|
| 7,775,330 | B2 * | 8/2010 | Kattainen | B66B 5/04 187/287 |
| 7,942,246 | B2 * | 5/2011 | Saarikoski | B66B 1/34 187/290 |
| 7,971,688 | B2 * | 7/2011 | Perala | B66B 1/30 187/293 |
| 8,066,101 | B2 * | 11/2011 | Yuasa | B66B 11/0476 187/251 |
| 8,297,413 | B2 * | 10/2012 | Kigawa | B66B 5/00 187/288 |
| 2016/0075536 | A1 * | 3/2016 | Metsanen | B66D 5/14 187/254 |
| 2016/0167921 | A1 * | 6/2016 | Kattainen | B66B 1/24 187/247 |

* cited by examiner

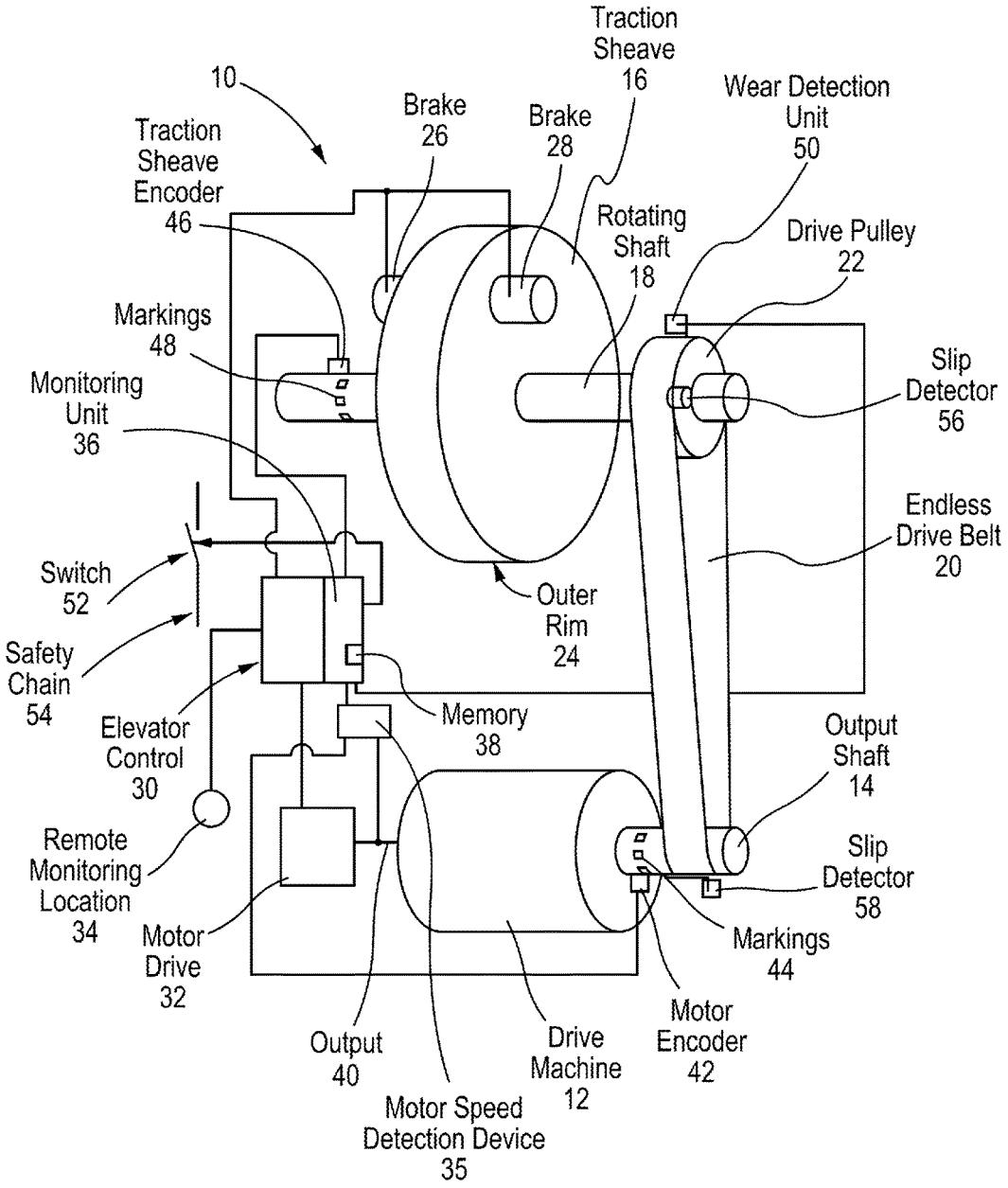
10
Traction Sheave Encoder 46
Brake 26
Brake 28
Traction Sheave 16
Wear Detection Unit 50
Rotating Shaft 18
Drive Pulley 22
Markings 48
Monitoring Unit 36
Slip Detector 56
Endless Drive Belt 20
Switch 52
Outer Rim 24
Safety Chain 54
Elevator Control 30
Memory 38
Output Shaft 14
Remote Monitoring Location 34
Slip Detector 58
Motor Drive 32
Markings 44
Motor Encoder 42
Output 40
Drive Machine 12
Motor Speed Detection Device 35

TRACTION SHEAVE ELEVATOR WITH DRIVE MEMBER SLIPPAGE CONTROL

BACKGROUND

Field

The present invention relates to a traction sheave elevator comprising a drive machine having an output shaft which is connected to the traction sheave via an endless drive member. Accordingly, the power transmission between drive machine and traction sheave occurs via the endless drive member.

Description of Related Art

Traction sheave elevators are known where the drive machine is connected to the traction sheave via endless drive members, e.g. endless belts or chains. According to EN81-1, the European regulations regarding the safety of elevators, at least two parallel drive members are required between the drive machine and the traction sheave for safety reasons.

The disadvantage of this arrangement is that it is quite bulky and the maintenance costs are essentially doubled up for the maintenance and replacement of two parallel drive belts even if only one of said parallel drive belts is worn out.

Furthermore traction sheave elevator drives are known where a traction sheave is connected with the elevator drive only via one simple belt, in which case the traction sheave has to be provided with a brake disk so that the brake is able to stop the traction sheave.

SUMMARY

It is therefore object of the invention to provide a traction sheave elevator of the afore mentioned type which provides a sufficient safety level and/or is less bulky.

The object is solved with a traction sheave elevator as described herein.

It is furthermore object of the invention to provide a method for driving the traction sheave in a traction sheave elevator wherein a drive machine drives the traction sheave via an endless drive member, which method shall provide a sufficient safety level and/or require a less bulky drive arrangement between the drive machine and the traction sheave.

Inventive embodiments are also presented in the description part and in the drawings of the present application. The inventive content may also consist of separate inventions, especially if the invention is considered in the light of explicit or implicit sub-tasks or in respect of advantages or sets of advantages achieved. In this case, some of the attributes contained in the claims below may be superfluous from the point of view of separate inventive concepts.

In the traction sheave elevator according to the present invention, an encoder is provided in connection with the traction sheave. This encoder is provided to take up the rotational speed of the traction sheave. The encoder may be located in connection with the traction sheave itself or with any element which is rotationally fixed to the traction sheave, e.g. its shaft.

The invention comprises a motor speed detection device. Such motor speed detection devices are commonly used in all modern elevators. These devices can for example use the signals of an encoder located in connection with a rotational part of the motor. The motor speed detection device may also have an input for the supply frequency of the motor drive fed to the drive machine. From the supply frequency, the motor speed detection device can easily calculate the corresponding rotational speed of the motor. The motor speed detection device may be a part of the elevator control or of the motor drive. Of course, the motor speed detection device can also be provided as a separate part.

Furthermore, according to the invention, a monitoring unit is provided to which the output signal of the encoder and a speed signal of the motor speed detection device are fed. The speed signal is the output signal of the speed detection device. The monitoring unit comprises a comparator which compares the output signal of the encoder with the speed signal of the motor speed detection device. During normal operation, these values are in a fixed relationship according to the transmission ratio of the endless drive member between the output shaft of the drive machine and the traction sheave. The monitoring unit initiates an emergency action if the result of the comparison deviates from an allowed value by a threshold value. The initiation of an emergency action could preferably include the opening of the safety chain of the elevator which leads to the braking of the traction sheave and to the stop of the drive machine. In this connection, it has to be carried out that in belt driven traction sheave elevators the brake has to be provided in connection with the traction sheave as on the traction sheave the elevator car and the counterweight—if present—are suspended.

In summary, the present invention replaces the—according to EN 81-1—obligatory second endless drive member by the use of only one drive member whereby the redundancy loss is compensated by the inventive monitoring device which ensures that the connection between the drive machine and the traction sheave via the endless drive member is working properly.

The term drive machine of the invention is used as a synonym for "motor". Accordingly the drive machine may be a geared motor or gearless motor. The drive machine may optionally also comprise power electronics of the motor drive. Particularly a permanent magnet motor is used as a drive machine.

Of course, further emergency actions could be initiated if the comparison exceeds a threshold value, e.g. the gripping device of the elevator car could be activated which ensures that the car is not crushing into the shaft pit. Optionally, an emergency signal could be given to a remote monitoring or maintenance location so that immediate action by service technicians can be initiated.

The advantage of the invention are the lower installation and maintenance costs of only one driving member, particularly driving belt or driving chain. Furthermore, by using only one endless drive element, the necessary space for its arrangement is halved with respect to the current arrangement prescribed by European regulations, which leads to less bulky drive structures.

As the motor speed is determined in all current elevator installations, only the speed of the traction sheave has to be determined additionally to enable the invention to work. As only one endless drive member is provided between the drive machine output shaft and a drive pulley on the shaft of the traction sheave, the arrangement is not that sensible with respect to small misalignments between the shafts of the drive machine and the traction sheave. The parameter tolerances are bigger which leads to less cost in the mechanical construction of the bedplate of the drive machine.

It is clear that instead of the output signal of the encoder and the speed signal of the motor speed detection device, also any signals can be used which are derived from said signals, e.g. signals which are integrated over a certain time, e.g. 0.1 s, to prevent any noise peaks causing emergency action without reason.

The motor speed can be detected either with an encoder located in connection with a rotating part of the motor, e.g. the rotor or the motor output shaft or from the supply frequency of the motor drive. Of course for redundancy reasons, both signals can be used, i.e. the supply frequency from the motor drive as well as a motor encoder signal. In any case, these signals from the motor drive or from the encoder are fed to the motor speed detection device which provides a speed signal as output signal indicating the rotational speed of the drive machine.

Preferably, the threshold value is a preset value, which is preferably input to the elevator control during the installation or maintenance of the elevator. This value can also be set via a remote monitoring location. The value can also be adapted during operation.

Of course, another advantage of the invention is obtained if only one single drive member is used to connect the drive machine with the traction sheave. In this case, all of the above-mentioned advantages regarding the space saving advantages are achieved. Of course, the invention can also be used in connection with several parallel endless drive members provided between the drive machine and the traction sheave. In this case the invention improves the general safety of the traction sheave elevator particularly in the drive section.

The invention also relates to a method for driving a traction sheave in a traction sheave elevator, in which the elevator drive machine drives the traction sheave via an endless drive member located between the output shaft of the drive machine and the traction sheave. Of course, the endless member is usually arranged on drive pulleys which are located on the output shaft of the drive machine as well as on the shaft of the traction sheave. In the invention, the speed of the traction sheave is measured and compared to the speed of the drive machine. An emergency action is initiated if the result of the comparison exceeds from a reference value by a threshold value. With respect to the effects and advantages of this inventive method, it is referred to the above description of the invention with respect to traction sheave elevator. The threshold value is preferably preset to a value which ensures that the velocity deviation at the rim of the traction sheave does not exceed a range between 0.01 m/s and 0.5 m/s. This would leave a certain slip of the endless drive member within the allowed range.

The reference value for the comparison as well as the threshold value are preferably stored in a non-volatile memory, which is preferably comprised in the elevator control or in the monitoring unit. Via this measure, it is possible to restart the traction sheave elevator in case of a power failure.

It is further preferable that the speed signal as well as the output signal of the encoder are reset to properly working values after a power failure. This is particularly relevant in case the supply frequency of the motor drive is used for deriving the speed signal.

Preferably, a wear detection unit is provided in connection with the endless drive member which either optically or via mechanical or electrical or magnetic means monitors the wear of the endless drive member. If the wear detection unit detects with an impermissible deviation of the actually measured values from distort reference value, a maintenance signal can be issued to a remote monitoring or maintenance location to initiate a service for the endless drive member, e.g. a replacement thereof.

Furthermore, a slip detector can be provided at the contact point of the endless drive member with the output shaft of the drive machine and/or with the shaft of the traction sheave. In this case the monitoring unit would be able to consider any occurring slip of the endless drive member on the drive pulleys in the comparison for initiating an emergency action. The values from the slip detector(s) can also be used to obtain any information about necessary maintenance, e.g. low tension of a drive belt.

Preferably, the difference between the output signal of the encoder and the speed signal is used to obtain a slip signal as maintenance signal for a remote monitoring or maintenance location to initiate a service for the endless drive member, e.g. a replacement thereof. If the difference of the values drifts apart within the threshold value this is a indication for increasing slip between the belt and the corresponding surfaces of the motor output shaft and the traction sheave or its shaft. Accordingly, via the monitoring of said slip signal the slip can be controlled and action can be taken, if necessary. Also in this case a reference value for slip signal or repeated measurements of the slip signal during the time of operation can be stored and used as reference value(s) to obtain a tendency of the slip over the time.

The invention is now described by the way of an example in connection with the enclosed drawing.

BRIEF DESCRIPTION OF THE DRAWING

FIG. 1 shows a schematic illustration of a traction sheave elevator.

DETAILED DESCRIPTION

FIG. 1 shows a traction sheave elevator 10 comprising a drive machine 12 with an output shaft 14 as well as a traction sheave 16 fixedly mounted on a rotating shaft 18. The shaft 18 of the traction sheave 16 is supported by bearings which are not shown in the drawing for clarity reasons. The output shaft 14 of the drive machine 12 and the shaft 18 of the traction sheave 16 are connected via an endless drive belt 20 running directly on the output shaft 14 and on a drive pulley 22 which is rotationally fixed to the shaft 18 of the traction sheave 16. The traction sheave 16 has on its outer rim 24 rope grooves or belt grooves on which hosting or suspension ropes/belts for driving an elevator car and optionally a counterweight are suspended. Two brakes 26, 28 are provided in connection with the traction sheave 16 which are located coaxially on both ends of the traction sheave. The two brakes 26, 28 serve to stop the traction sheave in case of an accident. The brakes 26, 28 are operated via an elevator control 30. The elevator control is connected to a motor drive 32, which comprises the components for the control of the drive machine 12, preferably also the power components as igbt transistors, thyristors, etc. The motor drive 32 is connected to the drive machine 12. The elevator control 30 is further connected to a remote monitoring or maintenance location 34 preferably via a telephone or internet connection. The elevator control 30 comprises a monitoring unit 36 which is provided to compare the speed of the drive machine with the speed of the traction sheave. The monitoring unit 36 comprises a memory 38 for reference values and threshold values. Further a motor speed detection device 35 is provided which is connected to the monitoring unit 36. The input of the speed detection device 35 is connected to the output 40 of the motor drive 32. By this connection, the motor speed detection device 35 obtains the frequency of the supply voltage to the drive machine which allows the calculation of the motor speed.

Furthermore, the input of the motor speed detection device 35 is connected with a motor encoder 42 which co-acts with markings 44 on the output shaft 14 of the drive machine 12 to obtain a speed signal of the drive machine.

The monitoring unit 36 is further connected with a traction sheave encoder 46 which is provided in connection with the shaft 18 of the traction sheave 16 thereby reading markings 48 on the circumference of the shaft 18 so as to obtain a speed signal of the traction sheave. Furthermore, the monitoring unit 36 is connected with a wear detection unit 50 which is located adjacent or in connection with the endless belt 20. Furthermore, the monitoring unit 36 is functionally connected with a switch 52 of the safety chain 54 of the elevator.

At the contact point of the drive belt 20 with the drive pulley a first slip detector 56 is provided and at the contact point of the drive belt 20 with the output shaft 14 a second slip detector 58 is provided. Both detectors 56, 58 are connected wirelessly with the monitoring unit 36. They may of course also be connected via normal wiring, e.g. a serial bus. The wear detection unit 50 as well as the slip detectors 56, 58 are optional units. In the embodiment, the monitoring unit 36 is part of the elevator control 30. This is however not necessary.

The invention works as follows:

During normal operation, the speed signal obtained from the motor encoder 42 or from the output 40 of the motor drive 32 has a certain relationship to the output signal of the traction sheave encoder 46. This fixed relationship depends on the transmission ratio of the endless belt 20 between the output shaft 14 of the drive machine 12 and the drive pulley 22 of the traction sheave 16. Anyway, during normal operation, a comparison of these signals corresponds to a reference value stored in the memory 38.

In case of a break of the endless drive belt 20 or an undue slip of the endless drive belt 20 on the output shaft 14 of the drive machine 12 or on the drive pulley 22 of the traction sheave 16, the comparison between the output signal of the traction sheave encoder 46 on one hand and the speed signal of the motor encoder 42 and/or of the output signal from the motor drive 32 deviates from the reference value by a threshold value also stored in the memory 38. In this case the monitoring unit 36 opens the switch 52 of the elevator safety chain 54 which leads to immediate stop of the drive machine 12 and via the elevator control to the activation of the traction sheave brakes 26 and 28 (by deenergizing them). Furthermore, the monitoring unit initiates via the elevator control 30 an emergency call to a remote monitoring or maintenance location 34 which is connected with the elevator control 30 via a telephone—or internet connection.

Via this measure, the operation safety of the traction sheave elevator can be maintained although only one single endless drive member in form of the endless drive belt 20 is provided between the drive machine 12 and the traction sheave 16.

The monitoring unit is in the illustrated embodiment also connected with wear detection unit 50 which optically scans the surface of the endless drive belt 20. The monitoring unit 36 compares the signals from the wear detection unit 50 with reference values stored in the memory 38 and issues a maintenance signal to the remote monitoring or maintenance location 34 which leads to a replacement of the endless drive belt 20 before it breaks. Further slip detectors 56, 58 are provided to detect slipping of the belt 20 on the drive pulley 22 or on the output shaft 14. These slip detectors 56, 58 may also be provided together with the wear detection unit 50 via one and the same sensors. The slip detectors and the wear unit are preferably fixed on a support in the close vicinity of the rotating parts. The slip detectors issue a slip signal to the monitoring unit 36 comprising information about the speed difference between the belt on one hand and the drive pulley 22 or the output shaft 14 on the other hand, respectively. If the speed difference deviates from a reference value stored in the non-volatile memory 38 by a also stored second threshold value a maintenance signal is issued to the remote monitoring or maintenance location 34 indicating due maintenance.

In some embodiments the wear detection can be done without additional slip detectors because the increasing difference between motor speed and traction sheave speed also indicates increasing slip and therefore wear of drive belt.

In the above embodiment, the speed signal of the motor speed detection device is obtained from the motor drive 32 as well as from the motor encoder 42. It is clear that the invention can be realized with only one of these two detection systems. Furthermore, it is clear to the skilled person that the motor speed detection device 35, the monitoring unit 36 as well as the elevator control 30 do not have to be provided as integrated units but can also be provided on separate locations. Of course, these components can also be provided as software components in a control program implemented in the elevator control 30.

Furthermore, it is clear that the motor encoder 42 can be located in connection with any other rotated part of the drive machine 12, e.g. in connection with the rotor of the drive machine 12. On this behalf, the motor encoder 42 could be located within the casing of the drive machine 12. In the same way it is clear that the traction sheave encoder 46 can be located in connection with any other rotatable part, e.g. in connection with the traction sheave 16 itself or with the drive pulley 22.

Of course the drive belt 20 could also be coupled directly to the traction sheave (instead of axis 22) in parallel with the elevator ropes.

It shall further be understood that the length of the output shaft 14 of the drive machine 12 as well as the length of the shaft 18 of the traction sheave 16 are exaggerated. The exaggerated lengths of the shafts have been chosen to illustrate the function of the invention. In reality, the shafts are much shorter.

It should be noted that the different embodiments mentioned in the description can be combined with each other. The invention can be varied within the scope of the appended patent claims.

The invention claimed is:

1. Traction sheave elevator comprising a drive machine having an output shaft which is connected to the traction sheave via an endless drive member, whereby an encoder is provided in connection with the traction sheave so as to obtain a speed signal of the traction sheave, a motor speed detection device is provided, a monitoring unit is provided to which the output signal of the encoder and a speed signal of the motor speed detection device are fed, the monitoring unit comprises a comparator which compares the output signal of the encoder with the speed signal of the motor speed detection device, the monitoring unit initiates an emergency action if the result of the comparison exceeds a threshold value.

2. Traction sheave elevator according to claim 1, wherein the supply frequency of the motor drive is fed to the motor speed detection device.

3. Traction sheave elevator according to claim 1, wherein the monitoring unit is configured to open the safety chain of the elevator.

4. Traction sheave elevator according to claim 1, wherein only one drive member connects the drive machine with the traction sheave.

5. Traction sheave elevator according to claim 1, wherein the monitoring unit is integrated in the elevator control or in the motor drive.

6. Traction sheave elevator according to claim 1, wherein the motor speed detection device comprises an encoder in connection with a rotating part of the drive machine.

7. Traction sheave elevator according to claim 1, wherein the motor speed detection device is provided connection with an elevator control or a motor drive or with the drive machine.

8. Traction sheave elevator according to claim 1, wherein a wear detection unit is provided in the vicinity of the endless drive member, which wear detection unit is connected with the monitoring unit.

9. Traction sheave elevator according to claim 1, wherein at least one slip detector is provided in the vicinity of the endless drive member and of the output shaft and/or a drive pulley of the traction sheave shaft, which slip detector is connected with the monitoring unit.

10. Method for driving a traction sheave in a traction sheave elevator, in which elevator a drive machine drives the traction sheave via an endless drive member located between the output shaft of the drive machine and the shaft of the traction sheave, whereby the speed of the traction sheave is measured and compared to the speed of the drive machine and an emergency action is initiated if the result of the comparison exceeds a threshold value.

11. Method according to claim 10, wherein the speed of the drive machine is obtained from the supply voltage frequency of a motor drive.

12. Method according to claim 10, wherein the speed of the traction sheave is obtained with an encoder provided in connection with the traction sheave.

13. Method according to claim 10, wherein the threshold value is preset to a value between 0.05 m/s and 1 m/s of the velocity of the traction sheave rim.

14. Method according to claim 10, wherein in case of the threshold value being exceeded a safety chain of the elevator is opened.

15. Method according to claim 10, wherein in case of the threshold value being exceeded a gripping device of the elevator car is activated.

16. Method according to claim 10, wherein the threshold value is stored in a memory.

* * * * *